US010907322B2

(12) United States Patent
Tsukamoto

(10) Patent No.: US 10,907,322 B2
(45) Date of Patent: Feb. 2, 2021

(54) SHOVEL

(71) Applicant: SUMITOMO(S.H.I.) CONSTRUCTION MACHINERY CO., LTD., Tokyo (JP)

(72) Inventor: Hiroyuki Tsukamoto, Chiba (JP)

(73) Assignee: SUMITOMO(S.H.I.) CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 16/018,366

(22) Filed: Jun. 26, 2018

(65) Prior Publication Data

US 2018/0298586 A1 Oct. 18, 2018

Related U.S. Application Data

(63) Continuation of application No. PCT/JP2016/089045, filed on Dec. 28, 2016.

(30) Foreign Application Priority Data

Dec. 28, 2015 (JP) ..... 2015-256682

(51) Int. Cl.

| | |
|---|---|
| ***E02F 9/22*** | (2006.01) |
| ***E02F 9/26*** | (2006.01) |
| *E02F 9/20* | (2006.01) |

(52) U.S. Cl.

CPC ..... *E02F 9/2246* (2013.01); *E02F 9/2203* (2013.01); *E02F 9/2235* (2013.01); *E02F 9/2285* (2013.01); *E02F 9/2292* (2013.01); *E02F 9/2296* (2013.01); *E02F 9/265* (2013.01); *E02F 9/2033* (2013.01)

(58) Field of Classification Search

CPC ..... E02F 9/22–2246
USPC ..... 37/347, 348; 172/2–11; 701/50
See application file for complete search history.

(56) References Cited

U.S. PATENT DOCUMENTS

| | | | | |
|---|---|---|---|---|
| 5,944,764 A * | 8/1999 | Henderson | E02F 9/2045 | 342/457 |
| 6,061,617 A * | 5/2000 | Berger | A01B 63/10 | 700/18 |
| 6,336,067 B1 * | 1/2002 | Watanabe | E02F 9/2228 | 37/414 |
| 6,363,632 B1 * | 4/2002 | Stentz | E02F 3/437 | 37/348 |

(Continued)

FOREIGN PATENT DOCUMENTS

| | | |
|---|---|---|
| JP | H09-270945 | 10/1997 |
| JP | 2000-291076 | 10/2000 |

(Continued)

OTHER PUBLICATIONS

International Search Report for PCT/JP2016/089045, dated Apr. 4, 2017.

*Primary Examiner* — Robert E Pezzuto
(74) *Attorney, Agent, or Firm* — IPUSA, PLLC

(57) ABSTRACT

A shovel includes a lower traveling body that runs, an upper rotating body that is rotatably mounted on the lower traveling body, a plurality of hydraulic actuators that are operated by hydraulic oil discharged by a hydraulic pump driven by an engine, a determining unit that determines a type of work, and a control unit that controls the hydraulic actuators based on the type of work determined by the determining unit.

7 Claims, 9 Drawing Sheets

(56) References Cited

U.S. PATENT DOCUMENTS

| | | | | |
|---|---|---|---|---|
| 6,393,959 | B1 * | 5/2002 | Amemiya | E02F 3/3609 172/122 |
| 7,630,793 | B2 * | 12/2009 | Thomas | E02F 9/26 700/275 |
| 8,244,438 | B2 * | 8/2012 | Koch | E02F 3/432 212/284 |
| 9,163,383 | B2 * | 10/2015 | Filla | E02F 9/2025 |
| 9,376,784 | B2 * | 6/2016 | O'Donnell | E02F 3/435 |
| 9,495,615 | B2 * | 11/2016 | Kang | E02F 3/963 |
| 2001/0032031 | A1 | 10/2001 | Ufheil | |
| 2005/0283295 | A1 * | 12/2005 | Normann | E02F 9/26 701/50 |
| 2011/0087407 | A1 | 4/2011 | Filla | |
| 2013/0345939 | A1 | 12/2013 | Magaki et al. | |
| 2014/0088839 | A1 | 3/2014 | Magaki et al. | |
| 2014/0130383 | A1 * | 5/2014 | Harrington | F41H 11/16 37/195 |
| 2015/0097412 | A1 * | 4/2015 | Smith | E21C 41/16 299/1.05 |
| 2015/0278638 | A1 * | 10/2015 | Kang | E02F 3/963 382/190 |
| 2017/0101761 | A1 * | 4/2017 | Wu | E02F 9/20 |
| 2018/0239849 | A1 * | 8/2018 | Martinsson | G06K 9/00791 |

FOREIGN PATENT DOCUMENTS

| | | |
|---|---|---|
| JP | 2004-324511 | 11/2004 |
| JP | 3677296 | 7/2005 |
| JP | 2007-061042 | 3/2007 |
| JP | 2008-008183 | 1/2008 |
| JP | 2008-240361 | 10/2008 |
| JP | 2012-172431 | 9/2012 |
| JP | 5145159 | 2/2013 |
| JP | 2013-159930 | 8/2013 |
| JP | 2014-153929 | 8/2014 |
| WO | 2012/121252 | 9/2012 |

* cited by examiner

SHOVEL

CROSS-REFERENCE TO RELATED APPLICATION

The present application is a continuation application filed under 35 U.S.C. 111(a) claiming benefit under 35 U.S.C. 120 and 365(c) of PCT International Application No. PCT/JP2016/089045, filed on Dec. 28, 2016, which is based on and claims the benefit of priority of Japanese Patent Application No. 2015-256682 filed on Dec. 28, 2015, the entire contents of which are incorporated herein by reference.

BACKGROUND OF THE INVENTION

1. Field of the Invention

An aspect of this disclosure relates to a shovel.

2. Description of the Related Art

There is a known control device for a construction machine that has multiple operation modes and controls, for example, an engine speed based on a selected operation mode.

The workload of a shovel, which is a construction machine, varies depending on the work to be performed. For example, the workload of loading work varies depending on an object to be loaded. Here, an operator does not always select an optimum operation mode based on work to be performed.

For this reason, settings such as an engine speed and a hydraulic pump based on the operation mode selected by the operator may not match the work to be performed, and may result in an unnecessary increase in the engine speed and low fuel efficiency or may not achieve the horsepower necessary for the work.

SUMMARY OF THE INVENTION

In an aspect of this disclosure, there is provided a shovel including a lower traveling body that runs, an upper rotating body that is rotatably mounted on the lower traveling body, a plurality of hydraulic actuators that are operated by hydraulic oil discharged by a hydraulic pump driven by an engine, a determining unit that determines a type of work, and a control unit that controls the hydraulic actuators based on the type of work determined by the determining unit.

DESCRIPTION OF THE PREFERRED EMBODIMENTS

An aspect of this disclosure provides a shovel whose hydraulic actuators can be optimally controlled depending on work.

Embodiments of the present invention are described below with reference to the accompanying drawings. The same reference number is assigned to the same component throughout the drawings, and repeated descriptions of the component may be omitted.

Figure 1:
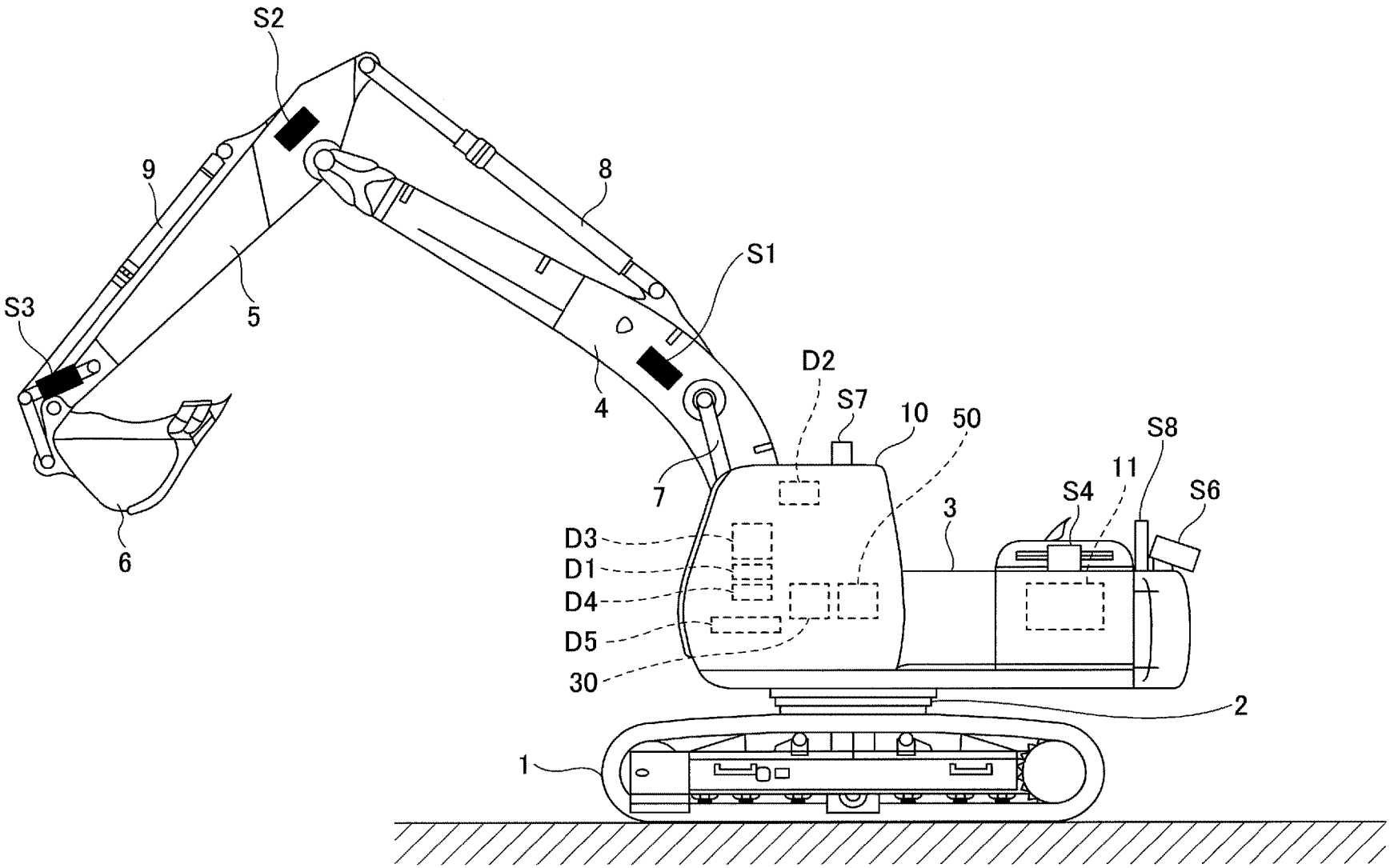
FIG. 1 is a side view of a shovel according to an embodiment.
Figure 2:
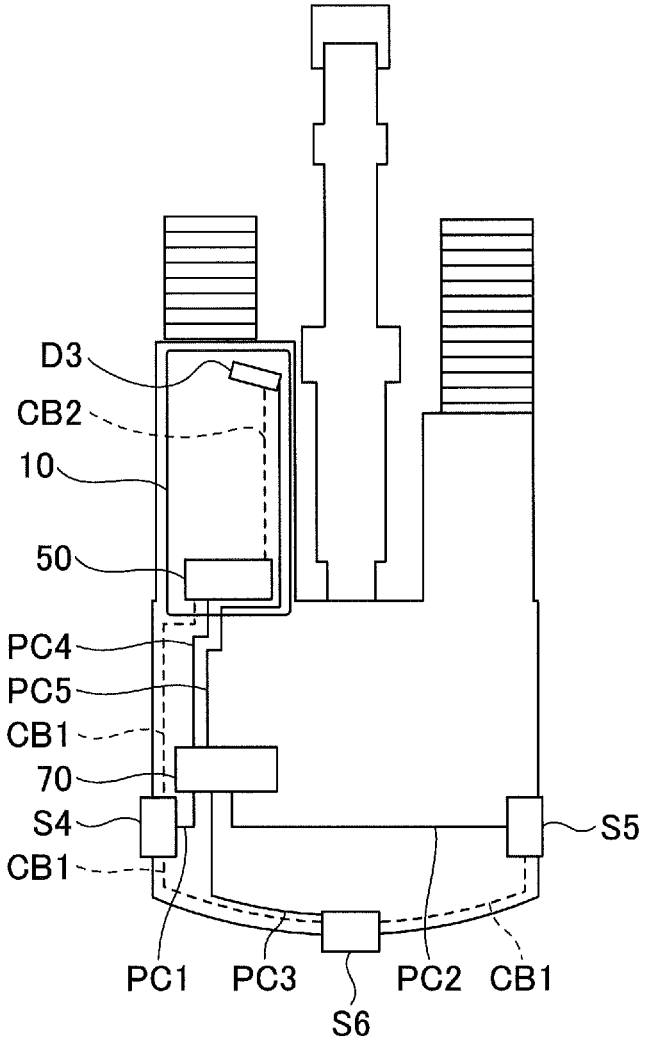
FIG. 2 is a top view of a shovel according to an embodiment.

FIG. 1 is a side view of a shovel according to an embodiment. FIG. 2 is a top view of the shovel according to the embodiment. FIG. 2 illustrates connections among cameras, a machine guidance device, and a display device.

The shovel includes a lower traveling body 1 on which an upper rotating body 3 is mounted via a rotation mechanism 2. A boom 4 is attached to the upper rotating body 3. An arm 5 is attached to an end of the boom 4 and a bucket 6, which is an end attachment, is attached to an end of the arm 5.

The boom 4, the arm 5, and the bucket 6 constitute an excavating attachment, which is an example of an attachment, and are hydraulically-driven by a boom cylinder 7, an arm cylinder 8, and a bucket cylinder 9, respectively. A boom angle sensor S1 is attached to the boom 4, an arm angle sensor S2 is attached to the arm 5, and a bucket angle sensor S3 is attached to the bucket 6.

The boom angle sensor S1 detects the rotation angle of the boom 4. In the present embodiment, the boom angle sensor S1 is an acceleration sensor that detects an inclination with respect to a horizontal plane and thereby detects the rotation angle of the boom 4 with respect to the upper rotating body 3.

The arm angle sensor S2 detects the rotation angle of the arm 5. In the present embodiment, the arm angle sensor S2 is an acceleration sensor that detects an inclination with respect to a horizontal plane and thereby detects the rotation angle of the arm 5 with respect to the boom 4.

The bucket angle sensor S3 detects the rotation angle of the bucket 6. In the present embodiment, the bucket angle sensor S3 is an acceleration sensor that detects an inclination with respect to a horizontal plane and thereby detects the rotation angle of the bucket 6 with respect to the arm 5.

Each of the boom angle sensor S1, the arm angle sensor S2, and the bucket angle sensor S3 may alternatively be implemented by a potentiometer using a variable resistor, a stroke sensor that detects the amount of stroke of a corresponding hydraulic cylinder, or a rotary encoder that detects a rotation angle around a coupling pin.

The upper rotating body 3 includes a cabin 10 and a power source such as an engine 11. A left-side camera S4, a right-side camera S5 (not shown in FIG. 1), and a rear camera S6 are attached to the upper rotating body 3. A communication device S7 and a positioning device S8 are attached to the upper rotating body 3. Also, a body inclination sensor for detecting an inclination angle with respect to a horizontal plane and an angular rotation rate sensor for detecting an angular rotation rate may be attached to the upper rotating body 3.

The left-side camera S4 is an imaging device that is attached to the left side of the upper rotating body 3 seen from an operator sitting on a driving seat and that captures images of surroundings on the left side of the shovel. The right-side camera S5 is an imaging device that is attached to the right side of the upper rotating body 3 seen from the operator sitting on the driving seat and that captures images of surroundings on the right side of the shovel. The rear camera S6 is an imaging device that is attached to the rear of the upper rotating body 3 and captures images of surroundings on the rear side of the shovel.

The communication device S7 controls communications between the shovel and external devices. In the present embodiment, the communication device S7 controls radio communications between a GNSS (global navigation satellite system) positioning system and the shovel. For example, the communication device S7 obtains topographical information of a work site once a day when shovel work is started. The GNSS positioning system employs, for example, a network RTK-GNSS positioning technique.

The positioning device S8 measures the position and the orientation of the shovel. In the present embodiment, the positioning device S8 is a GNSS receiver including an electronic compass, and measures the latitude, the longitude, and the altitude of the current position of the shovel as well as the orientation of the shovel. The positioning device S8 may be configured to obtain current position information of the shovel from, for example, a GPS.

An input device D1, an audio output device D2, a display device D3, a storage device D4, a gate lock lever D5, a controller 30, and a machine guidance device 50 are disposed in the cabin 10.

The controller 30 functions as a main controller that controls the shovel. In the present embodiment, the controller 30 is implemented by an arithmetic processing unit including a CPU and an internal memory. Various functions of the controller 30 are implemented by executing programs stored in the internal memory by the CPU.

The machine guidance device 50 guides the operator in operating the shovel. For example, the machine guidance device 50 visually and aurally informs the operator of a distance in the vertical direction between a target work surface set by the operator and the position of the tip (toe) of the bucket 6 to guide the operator in operating the shovel. The machine guidance device 50 may be configured to inform the operator of the distance only visually or only aurally.

Similarly to the controller 30, the machine guidance device 50 is implemented by an arithmetic processing unit including a CPU and an internal memory. Various functions of the machine guidance device 50 are implemented by executing programs stored in the internal memory by the CPU. The machine guidance device 50 may be either provided separately from the controller 30 or incorporated in the controller 30.

The input device D1 is used by the operator of the shovel to input various types of information to the machine guidance device 50. In the present embodiment, the input device D1 is implemented as membrane switches disposed around the display device D3. The input device D1 may also be implemented by, for example, a touch panel.

The audio output device D2 outputs various types of audio information according to audio output commands from the machine guidance device 50. In the present embodiment, an in-vehicle speaker connected to the machine guidance device 50 is used as the audio output device D2. The audio output device D2 may also be implemented by an alarm such as a busser.

The display device D3 outputs various types of image information according to commands from the machine guidance device 50. In the present embodiment, an in-vehicle liquid-crystal display connected to the machine guidance device 50 is used as the display device D3.

The storage device D4 stores various types of information. In the present embodiment, a nonvolatile storage medium such as a semiconductor memory is used as the storage device D4. The storage device D4 stores various types of information output from, for example, the machine guidance device 50.

The gate lock lever D5 is a mechanism that prevents the shovel from being operated by mistake. In the present embodiment, the gate lock lever D5 is disposed between a door of the cabin 10 and the driving seat. When the gate lock lever D5 is pulled up to prevent the operator from exiting the cabin 10, operating devices become usable. When the gate lock lever D5 is pressed down to allow the operator to exit the cabin 10, the operating devices become unusable.

As illustrated in FIG. 2, the left-side camera S4, the right-side camera S5, and the rear camera S6 are connected via a transmission medium CB1 to the machine guidance device 50 disposed in the cabin 10. The machine guidance device 50 is connected via a transmission medium CB2 to the display device D3 attached to a right oblique pillar in the cabin 10.

The transmission medium CB1 is laid out along the inner wall of a housing of the upper rotating body 3. The transmission medium CB2 is laid out along the inner wall of the cabin 10. The transmission media CB1 and CB2 are implemented by, for example, cables such as coaxial cables.

The left-side camera S4, the right-side camera S5, the rear camera S6, the machine guidance device 50, and the display device D3 are connected via power cables PC1, PC2, PC3, PC4, and PC5 to a storage battery 70, respectively.

Figure 3:
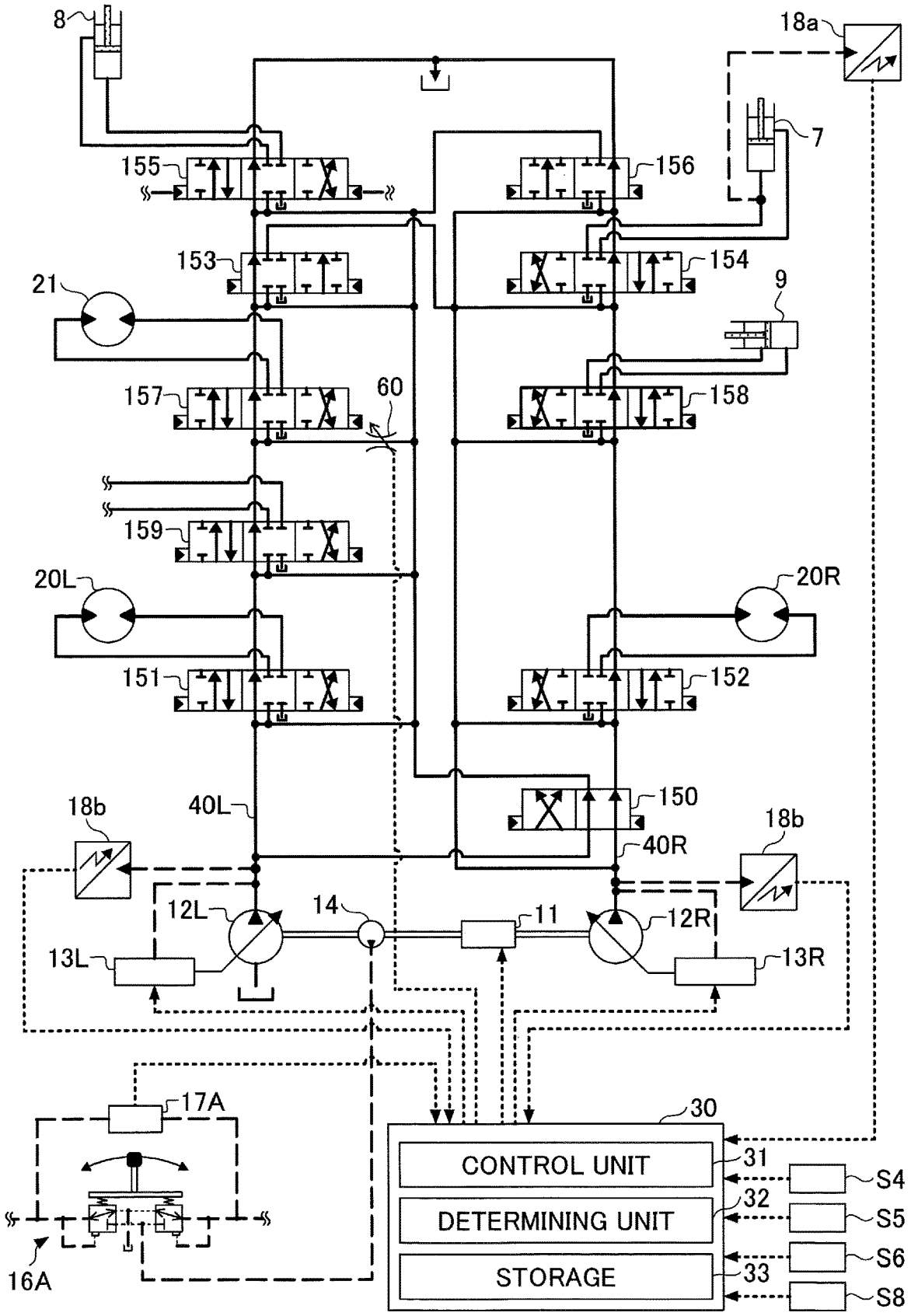
FIG. 3 is a drawing illustrating an example of a hydraulic system of a shovel according to an embodiment.

FIG. 3 is a drawing illustrating an example of a hydraulic system of the shovel according to an embodiment. In FIG. 3, mechanical power transmissions are indicated by double lines, high-pressure hydraulic lines are indicated by solid lines, pilot lines are indicated by dashed lines, and electric drive and control lines are indicated by dotted lines.

Hydraulic actuators provided in the shovel include the boom cylinder 7, the arm cylinder 8, the bucket cylinder 9, a traveling hydraulic motor 20L (left), a traveling hydraulic motor 20R (right), and a rotating hydraulic motor 21. In the hydraulic system, hydraulic oil discharged from main pumps 12L and 12R is selectively supplied to one or more hydraulic actuators.

The hydraulic system is configured to circulate hydraulic oil from two main pumps 12L and 12R driven by the engine 11, via center bypass pipe lines 40L and 40R, to a hydraulic oil tank. The center bypass pipe line 40L is a high-pressure hydraulic line that passes through flow control valves 151, 153, 155, 157, and 159 disposed in a control valve system. The center bypass pipe line 40R is a high-pressure hydraulic line that passes through flow control valves 150, 152, 154, 156, and 158 disposed in a control valve system.

The flow control valves 153 and 154 are spool valves that supply the hydraulic oil discharged from the main pumps 12L and 12R to the boom cylinder 7 and also change the flow of the hydraulic oil so that the hydraulic oil is discharged from the boom cylinder 7 into the hydraulic oil tank. The flow control valve 154 operates when a boom operation lever 16A is operated. The flow control valve 153 operates only when the boom operation lever 16A is operated a predetermined operation amount or more.

The flow control valves 155 and 156 are spool valves that supply the hydraulic oil discharged from the main pumps 12L and 12R to the arm cylinder 8 and also change the flow of the hydraulic oil so that the hydraulic oil is discharged from the arm cylinder 8 into the hydraulic oil tank. The flow control valve 155 operates when an arm operation lever (not shown) is operated. The flow control valve 156 operates only when the arm operation lever is operated a predetermined operation amount or more.

The flow control valve 157 is a spool valve that changes the flow of the hydraulic oil discharged from the main pump 12L so that the hydraulic oil is circulated by the rotating hydraulic motor 21.

The flow control valve 158 is a spool valve that supplies the hydraulic oil discharged from the main pump 12R to the bucket cylinder 9 and discharges the hydraulic oil from the bucket cylinder 9 into the hydraulic oil tank.

The flow control valve 159 is a spool valve that supplies the hydraulic oil discharged from the main pump 12L to an external device and discharges the hydraulic oil from the external device into the hydraulic oil tank. The external device is, for example, a harvester attached to an end of the arm.

Regulators 13L and 13R adjust the inclination angles of swash plates of the main pumps 12L and 12R to control the discharge rates of the main pumps 12L and 12R. The regulators 13L and 13R adjust the inclination angles of the swash plates according to control signals sent from the controller 30 (a control unit 31) to increase or decrease the discharge rates and thereby control the horsepower output by the main pumps 12L and 12R.

The boom operation lever 16A is an operating device for operating the boom 4, and introduces a control pressure corresponding to a lever operation amount to one of right and left pilot ports of the flow control valve 154 by using the hydraulic oil discharged from a control pump. When the lever operation amount is greater than or equal to a predetermined operation amount, the hydraulic oil is also introduced to one of right and left pilot ports of the flow control valve 153.

A pressure sensor 17A detects pilot pressures representing an operation (a lever operation direction and a lever operation amount (lever operation angle)) performed by the operator on the boom operation lever 16A, and outputs the detected pilot pressures to the controller 30.

Operating devices provided in the shovel of the present embodiment include, in addition to the boom operation lever 16A, right and left driving levers (or pedals), an arm operation lever, a bucket operation lever, and a rotating lever. The right and left driving levers are operating devices for controlling the running of the lower traveling body 1. The arm operation lever is an operating device for opening and closing the arm 5. The bucket operation lever is an operating device for opening and closing the bucket 6.

Similarly to the boom operation lever 16A, each of these operation devices introduces a control pressure corresponding to a lever operation amount (or a pedal operation amount) to one of right and left pilot ports of a flow control valve corresponding to one of the hydraulic actuators by using the hydraulic oil discharged from the control pump. Also, similarly to the pressure sensor 17A, a pressure sensor corresponding to each of these operation devices detects pressures representing an operation (a lever operation direction and a lever operation amount) performed by the operator on the corresponding operation device and outputs the detected pressures to the controller 30.

The controller 30 is connected to the left-side camera S4, the right-side camera S5, the rear camera S6, and the positioning device S8. The controller 30 receives, from the left-side camera S4, the right-side camera S5, and the rear camera S6, data of images captured by those cameras. The controller 30 receives, from the positioning device S8, current position information of the shovel obtained by the positioning device D8. The controller 30 receives outputs from a boom cylinder pressure sensor 18*a* and a discharge pressure sensor 18*b*.

The controller 30 includes a control unit 31, a determining unit 32, and a storage 33. The control unit and the determining unit 32 are implemented by executing programs stored in an internal memory by a CPU provided in the controller 30. The storage 33 is a memory such as a ROM provided in the controller 30.

The control unit 31 sends control signals to the regulators 13L and 13R and a variable throttle 60. The regulators 13L and 13R adjust the inclination angles of the swash plates based on the control signals sent from the control unit 31 to increase or decrease the discharge rates and thereby change the horsepower output by the main pumps 12L and 12R. The variable throttle 60 changes the flow rate of the hydraulic oil into the rotating hydraulic motor 21 by changing its aperture based on the control signal sent from the control unit 31.

The determining unit 32 determines a type of work to be performed by the shovel based on camera images of surroundings of the shovel that are captured by the left-side camera S4, the right-side camera S5, and the rear camera S6. The camera images include actual images captured by the left-side camera S4, the right-side camera S5, and the rear camera S6 and images generated based on the captured images.

The determining unit 32 obtains feature values such as shapes and colors of objects in the camera images using, for example, a known image recognition process, compares the obtained feature values with feature-value data stored in the storage 33, and identifies the type of a work site where the shovel is present. The known image recognition process may be, for example, an image recognition process using a SIFT (Scale-Invariant Feature Transform) algorithm, a SURF (Speeded-Up Robust Features) algorithm, an ORB (Oriented Binary Robust Independent Elementary Features (BRIEF)) algorithm, or a HOG (Histograms of Oriented Gradients) algorithm, or an image recognition process using pattern matching.

FIGS. 4A through 4D are drawings illustrating examples of camera images.

Figure 4A:
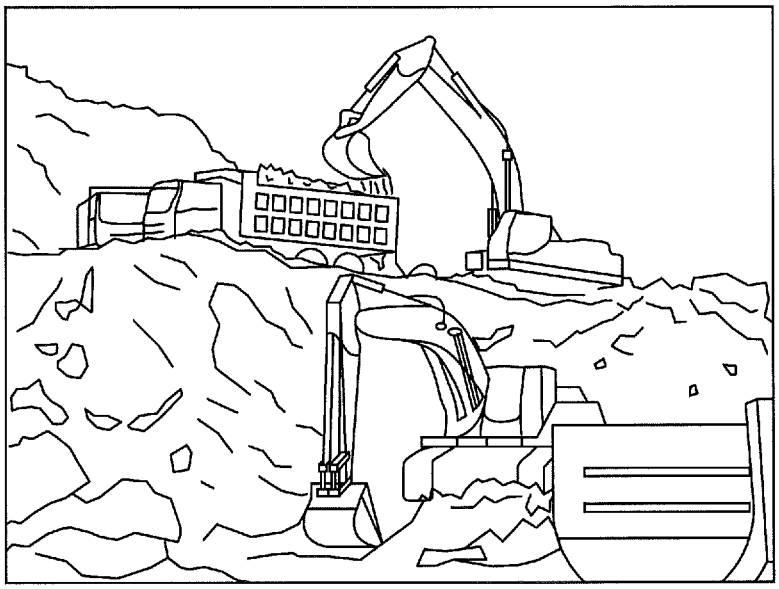
FIG. 4A is a drawing illustrating an example of a camera image in a quarrying site.

FIG. 4A is a drawing illustrating an example of a camera image in a quarrying site. For example, through an image recognition process based on the camera image of FIG. 4A, the determining unit 32 recognizes that the shovel is in a quarrying site and determines that the work to be performed by the shovel is loading and unloading of crushed stone.

Figure 4B:
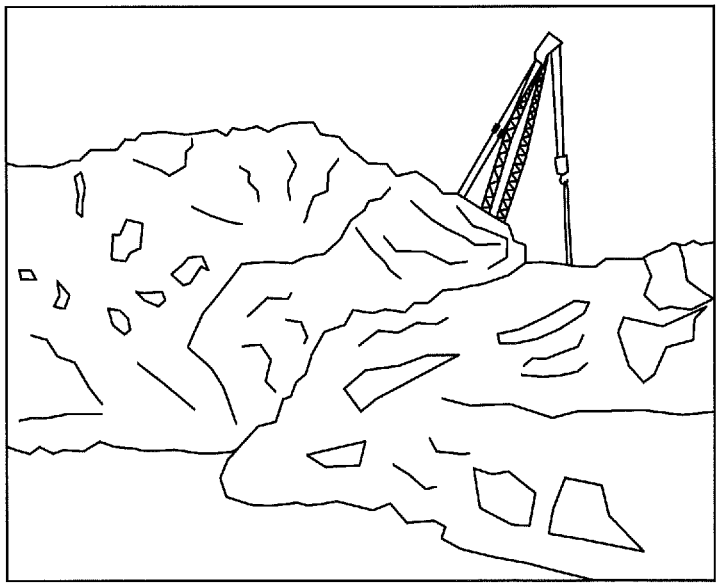
FIG. 4B is a drawing illustrating an example of a camera image in a scrap material handling site.

FIG. 4B is a drawing illustrating an example of a camera image in a scrap material handling site. For example, through an image recognition process based on the camera image of FIG. 4B, the determining unit 32 recognizes that the shovel is in a scrap material handling site and determines that the work to be performed by the shovel is scrap material handling. When scrap material handling is to be performed, for example, a magnet (for attracting metal) and a grapple (for nonferrous metal) are attached to an end of the arm of the shovel.

Figure 4C:
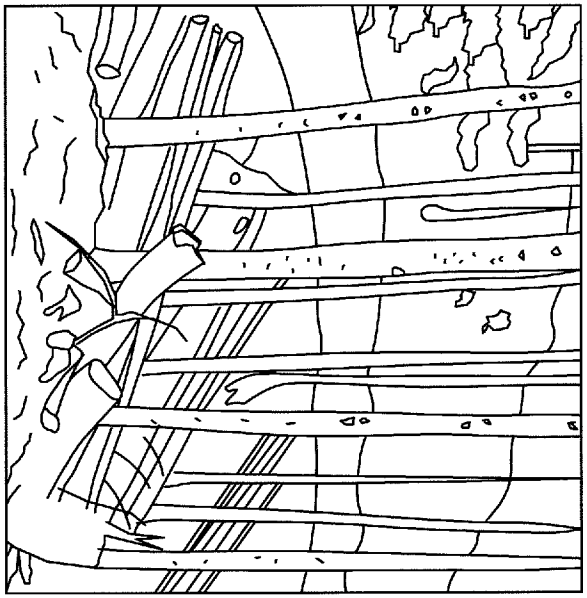
FIG. 4C is a drawing illustrating an example of a camera image in a felling site in forestry.

FIG. 4C is a drawing illustrating an example of a camera image in a felling site in forestry. For example, through an image recognition process based on the camera image of FIG. 4C, the determining unit 32 recognizes that the shovel is in a felling site in forestry and determines that the work to be performed by the shovel is felling. The shovel can cut trees by, for example, rotating the upper rotating body 3 and sweeping the trees with the arm 5 and the bucket 6 rotating together with the upper rotating body 3. When felling is to be performed, for example, a harvester is attached to an end of the arm of the shovel.

Figure 4D:
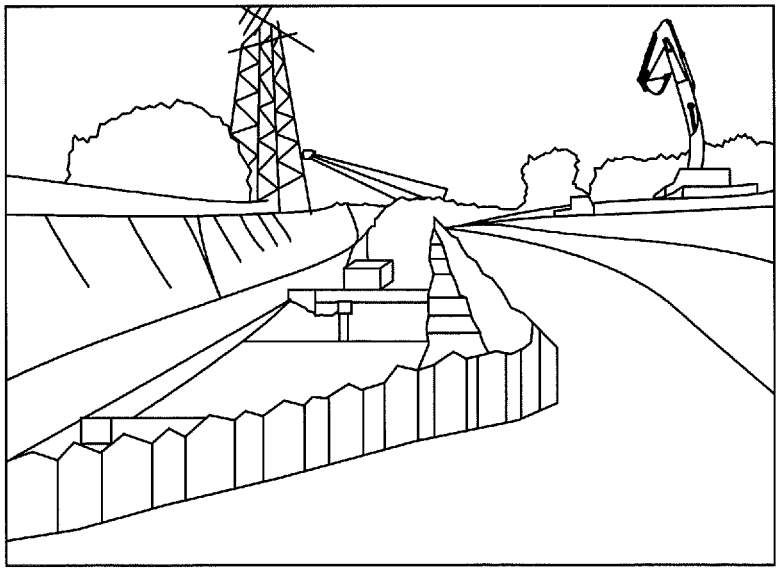
FIG. 4D is a drawing illustrating an example of a camera image in an urban earthwork site.

FIG. 4D is a drawing illustrating an example of a camera image in an urban earthwork site. For example, through an image recognition process based on the camera image of FIG. 4D, the determining unit 32 recognizes that the shovel is in an urban earthwork site and determines that the work to be performed by the shovel is earthwork such as excavation.

Types of work determined by the determining unit 32 are not limited to the above examples. For example, the determining unit 32 may recognize that the shovel is in a site such as a paddy field, a bank, or a farm based on a camera image, and determine the type of work to be performed in the site.

The determining unit 32 may be configured to determine the type of work to be performed by the shovel based on current position information obtained by the positioning device S8 and geographical information stored in the storage 33.

The storage 33 stores geographical information including, for example, map information, topographical information of mountains and rivers, and positional information of coastlines, boundaries of public facilities, and administrative boundaries. The determining unit 32 obtains geographical information corresponding to the current position of the shovel from the storage 33, determines, for example, whether the shovel is in a felling site in a forest or an earthwork site in a city based on the geographical information, and determines the type of work to be performed by the shovel.

Based on the determination result of the determining unit 32, the control unit 31 controls hydraulic actuators of the shovel. In the present embodiment, the control unit 31 changes the distribution of flow rates of hydraulic oil to the hydraulic actuators based on the determination result of the determining unit 32. Based on the determination result of the determining unit 32, the control unit 31 changes the horsepower of the main pumps 12L and 12R that are hydraulic pumps.

Figure 5:
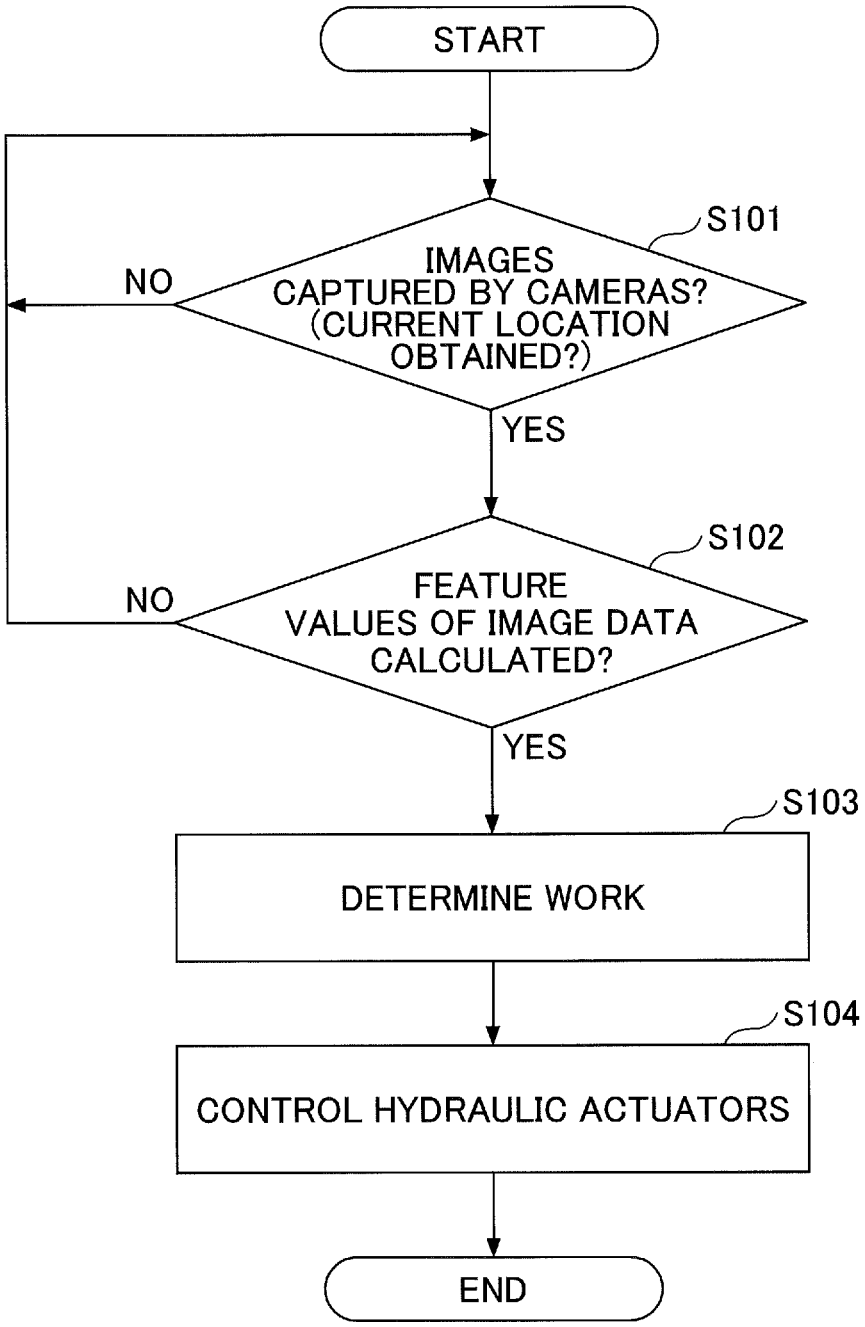
FIG. 5 is a flowchart illustrating an example of a hydraulic actuator control process.

FIG. 5 is a flowchart illustrating an example of a hydraulic actuator control process.

In the present embodiment, when the ignition of the shovel is turned on, the electric system of the shovel is started and the hydraulic actuator control process of FIG. 5 is performed. For example, the hydraulic actuator control process may be performed at predetermined intervals or when the shovel stops running.

At step S101 of the hydraulic actuator control process, the left-side camera S4, the right-side camera S5, and the rear camera S6 capture images of surroundings of the shovel. The camera images captured by the left-side camera S4, the right-side camera S5, and the rear camera S6 are sent to the controller 30.

Next, at step S102, the determining unit 32 performs an image recognition process on the camera images captured by the left-side camera S4, the right-side camera S5, and the rear camera S6, and calculates feature values of the camera images.

After the cameras capture images of the surroundings of the shovel at step S101 and the determining unit 32 calculates feature values of the camera images at step S102, the process proceeds to step S103. At step S103, the determining unit 32 compares the calculated feature values with feature value data stored in the storage 33 and determines the type of work based on a work site of the shovel.

The determining unit 32 may not necessarily determine the type of work based on camera images. For example, the determining unit 32 may determine the type of work based on current position information obtained by the positioning device S8. When the type of work is determined based on current position information of the shovel obtained by the positioning device S8, the positioning device S8 obtains the current position information at step S101. Then, at step S103, the determining unit 32 determines the type of work based on the current position information and geographical information stored in the storage 33. Also, the type of work may be determined based on both of the camera images and the current position information.

At step S104, the control unit 31 controls hydraulic actuators of the shovel based on the determination result of the determining unit 32.

Figure 6:
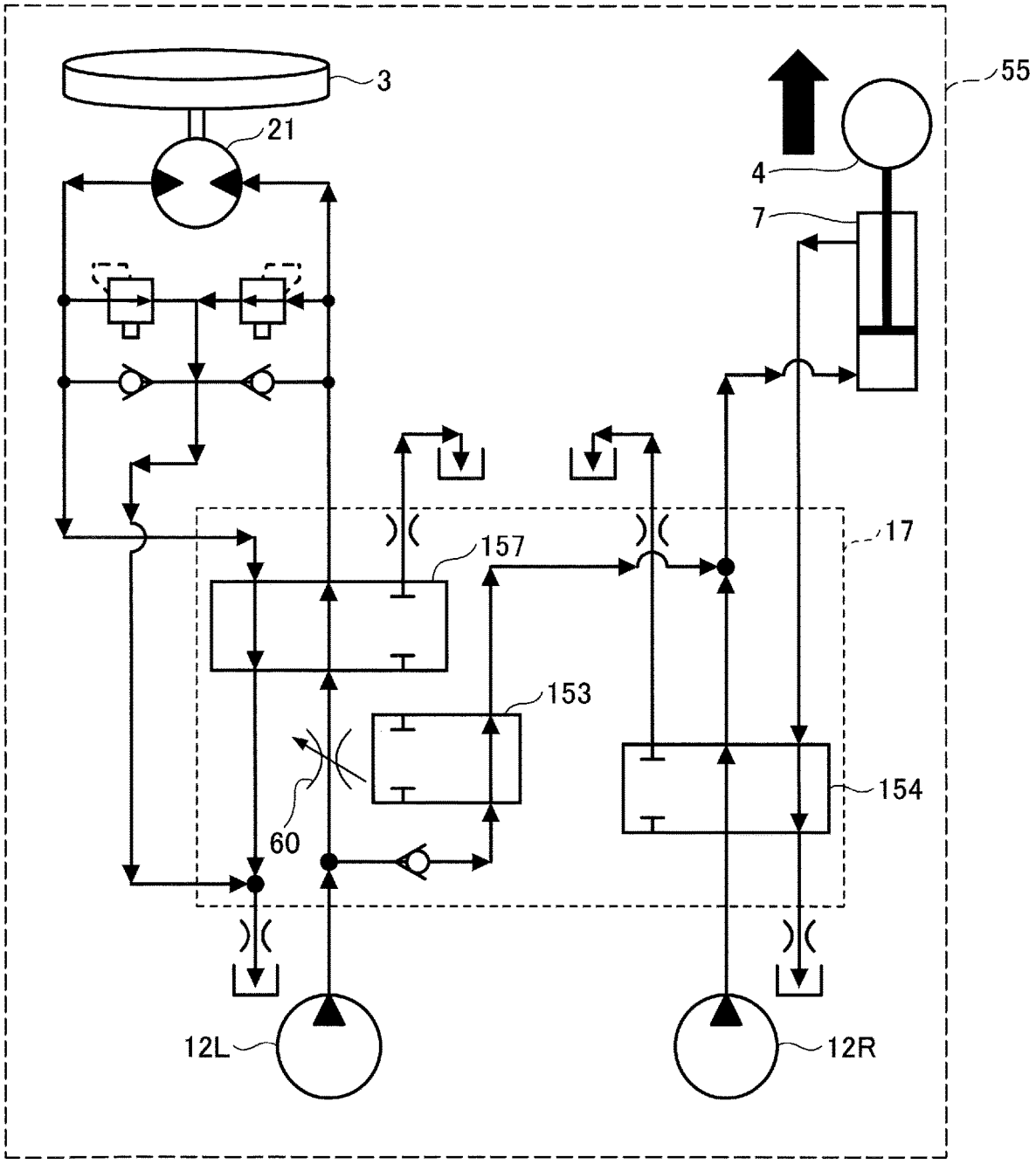
FIG. 6 is a drawing illustrating an example of a hydraulic drive circuit including a rotation hydraulic motor and a boom cylinder.

FIG. 6 is a drawing illustrating an example of a hydraulic drive circuit 55 including a rotation hydraulic motor and a boom cylinder.

The hydraulic drive circuit 55 of FIG. 6 includes a hydraulic circuit for driving the rotating hydraulic motor 21 that rotates the upper rotating body 3 and a hydraulic circuit for causing the boom cylinder 7 to reciprocate. In the hydraulic drive circuit 55, a hydraulic circuit portion 17 surrounded by a dotted line indicates a hydraulic circuit provided in the control valve system.

A pilot pressure is supplied from a pilot hydraulic circuit to the hydraulic circuit portion 17. More specifically, a pilot pressure adjusted by the boom operation lever 16A is supplied to the flow control valves 153 and 154 of the control valve system. A pilot pressure adjusted by the rotating lever is supplied to the flow control valve 157 of the control valve system. Each of the flow control valves 153, 154, and 157 is a spool valve where a spool moves in proportion to the pilot pressure and opens the oil passage.

When the boom operation lever 16A is operated in a direction to raise the boom 4, a control pressure adjusted according to the operation amount of the boom operation lever 16A is supplied from the pilot pump to the flow control valves 153 and 154. The pilot pressure causes the spools in the flow control valves 153 and 154 to move and open the oil passages. As a result, the hydraulic oil from the main pumps 12L and 12R is supplied via the flow control valves 153 and 154 to the bottom side of the boom cylinder 7, and the boom 4 is raised.

When the rotating lever is operated in a direction to rotate the upper rotating body 3, a control pressure adjusted according to the operation amount of the rotating lever is supplied from the pilot pump to the flow control valve 157. The pilot pressure causes the spool in the flow control valve 157 to move and open the oil passage. As a result, the hydraulic oil from the main pumps 12L and 12R is supplied to the rotating hydraulic motor 21, and the upper rotating body 3 is rotated.

The variable throttle 60 is provided between the main pump 12L and the flow control valve 157. The variable throttle 60 can change its aperture according to a control signal sent from the control unit 31.

When the variable throttle 60 decreases the aperture according to a control signal, the flow rate of the hydraulic oil supplied from the main pump 12L via the flow rate valve 157 into the rotating hydraulic motor 21 decreases. When the flow rate of the hydraulic oil into the flow control valve 157 decreases, the flow rate of the hydraulic oil that flows via the flow control valve 153 to the boom cylinder 7 increases. In this state, the output torque of the rotating hydraulic motor 21 decreases due to the decrease in the flow rate of the hydraulic oil, and the cylinder output of the boom cylinder 7 increases due to the increase in the flow rate of the hydraulic oil.

When the variable throttle 60 increases the aperture according to a control signal, the flow rate of the hydraulic oil that flows via the flow rate valve 157 to the rotating hydraulic motor 21 increases. When the flow rate of the hydraulic oil into the flow control valve 157 increases, the flow rate of the hydraulic oil that flows via the flow control valve 153 to the boom cylinder 7 decreases. In this state, the output torque of the rotating hydraulic motor 21 increases due to the increase in the flow rate of the hydraulic oil, and the cylinder output of the boom cylinder 7 decreases due to the decrease in the flow rate of the hydraulic oil.

The control unit 31 sends a control signal to change the aperture of the variable throttle 60 based on the result of determining the work of the shovel by the determining unit 32. For example, in work such as quarrying or earthwork, operations for moving the boom 4 up and down are performed more frequently than operations for rotating the upper rotating body 3. For this reason, when the determining unit 32 determines that the work of the shovel is quarrying or earthwork, the control unit 31 sends a control signal that causes the variable throttle 60 to decrease its aperture.

When the aperture of the variable throttle 60 is decreased, the flow rate of the hydraulic oil into the flow control valve 157 decreases, which results in a decrease in the output torque of the rotating hydraulic motor 21; and the flow rate of the hydraulic oil into the flow control valve 153 increases, which results in an increase in the cylinder output of the boom cylinder 7. Thus, when the work of the shovel is quarrying or earthwork, the control unit 31 increases the flow rate of the hydraulic oil into the boom cylinder 7 and thereby increases the cylinder output of the boom cylinder 7 that is frequently used in the work.

As another example, in work such as material handling or felling, operations for rotating the upper rotating body 3 are performed more frequently than operations for moving the boom 4 up and down. For this reason, when the determining unit 32 determines that the work of the shovel is material handling or felling, the control unit 31 sends a control signal that causes the variable throttle 60 to increase its aperture.

When the aperture of the variable throttle 60 is increased, the flow rate of the hydraulic oil into the flow control valve 157 increases, which results in an increase in the output torque of the rotating hydraulic motor 21; and the flow rate of the hydraulic oil into the flow control valve 153 decreases, which results in a decrease in the cylinder output of the boom cylinder 7. Thus, when the work of the shovel is material handling or felling, the control unit 31 increases the flow rate of the hydraulic oil into the rotating hydraulic motor 21 and thereby increases the output torque of the rotating hydraulic motor 21 that is frequently used in the work.

As described above, it is possible to efficiently obtain power output necessary for work to be performed by the shovel by changing the aperture of the variable throttle 60 according to the type of work and thereby changing the distribution of flow rates of the hydraulic oil to the rotating hydraulic motor 21 and the boom cylinder 7 that are examples of hydraulic actuators.

Figure 7A:
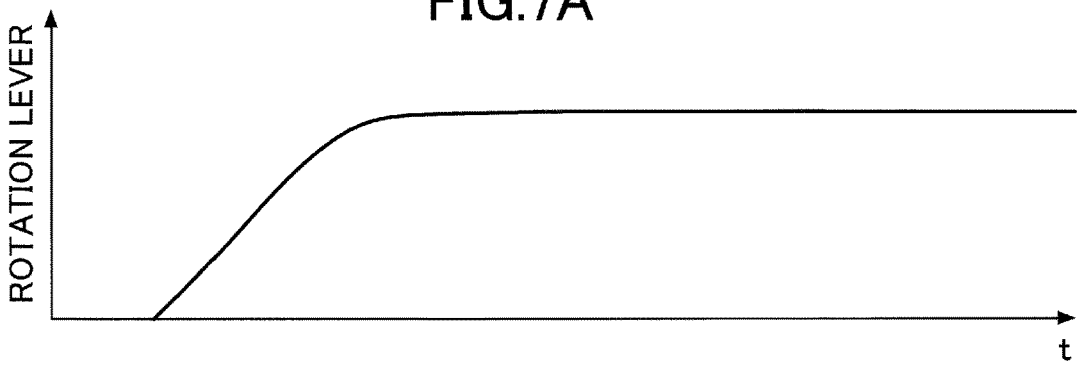
FIGS. 7A through 7D are time charts indicating lever operation amounts and flow rates of hydraulic oil into hydraulic actuators.
Figure 7B:
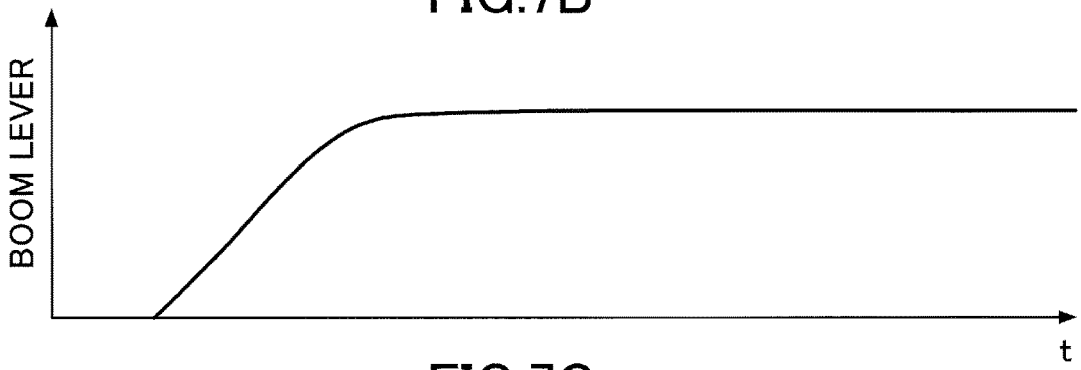
Figure 7C:
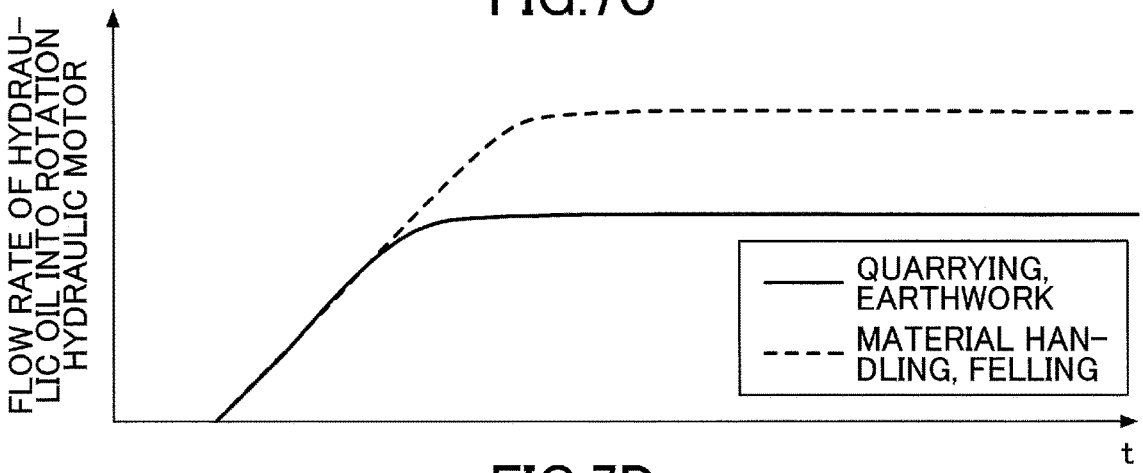
Figure 7D:
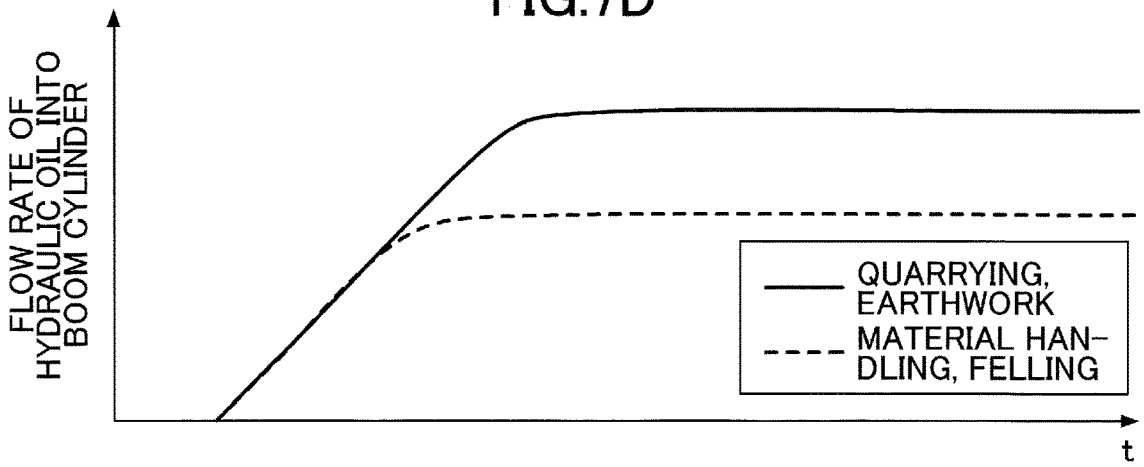

FIGS. 7A through 7D are time charts indicating lever operation amounts and flow rates of hydraulic oil into hydraulic actuators. FIG. 7A indicates a pilot pressure adjusted by operating the rotating lever, FIG. 7B indicates a pilot pressure adjusted by operating the boom operation lever, FIG. 7C indicates the flow rate of hydraulic oil into the rotating hydraulic motor 21, and FIG. 7D indicates the flow rate of hydraulic oil into the boom cylinder 7.

In the present embodiment, when work to be performed by the shovel is quarrying or earthwork, the variable throttle 60 is controlled such that the flow rate of hydraulic oil into the rotating hydraulic motor 21 decreases and the flow rate of hydraulic oil into the boom cylinder 7 increases. When work to be performed by the shovel is material handling or felling, the variable throttle 60 is controlled such that the flow rate of hydraulic oil into the rotating hydraulic motor 21 increases and the flow rate of hydraulic oil into the boom cylinder 7 decreases.

For the above reasons, the maximum flow rate of hydraulic oil into the rotating hydraulic motor 21 when the shovel work is material handling or felling is greater than the maximum flow rate of hydraulic oil into the rotating hydraulic motor 21 when the shovel work is quarrying or earthwork. In contrast, the maximum flow rate of hydraulic oil into the boom cylinder 7 when the shovel work is quarrying or earthwork is greater than the maximum flow rate of hydraulic oil into the boom cylinder 7 when the shovel work is material handling or felling.

Thus, the control unit 31 can optimize the distribution of flow rates of hydraulic oil depending on the type of shovel work and efficiently obtain power output necessary for the shovel work by changing the flow rates of hydraulic oil into the rotating hydraulic motor and the boom cylinder 7 based on the determination result of the determining unit 32.

In the present embodiment, the hydraulic drive circuit is configured such that the flow rate of hydraulic oil into the rotating hydraulic motor 21 is adjusted. However, the hydraulic drive circuit may be configured such that the flow rates of hydraulic oil into other hydraulic actuators are adjusted. For example, variable throttles for adjusting the flow rates of hydraulic oil into the boom cylinder 7, the arm cylinder 8, and the bucket cylinder 9 may be provided in the corresponding parts of the hydraulic drive circuit, and the control unit 31 may be configured to control the apertures of those variable throttles.

The control unit 31 may be configured to change the horsepower of the main pumps 12L and 12R based on the determination result of the determining unit 32.

Figure 8:
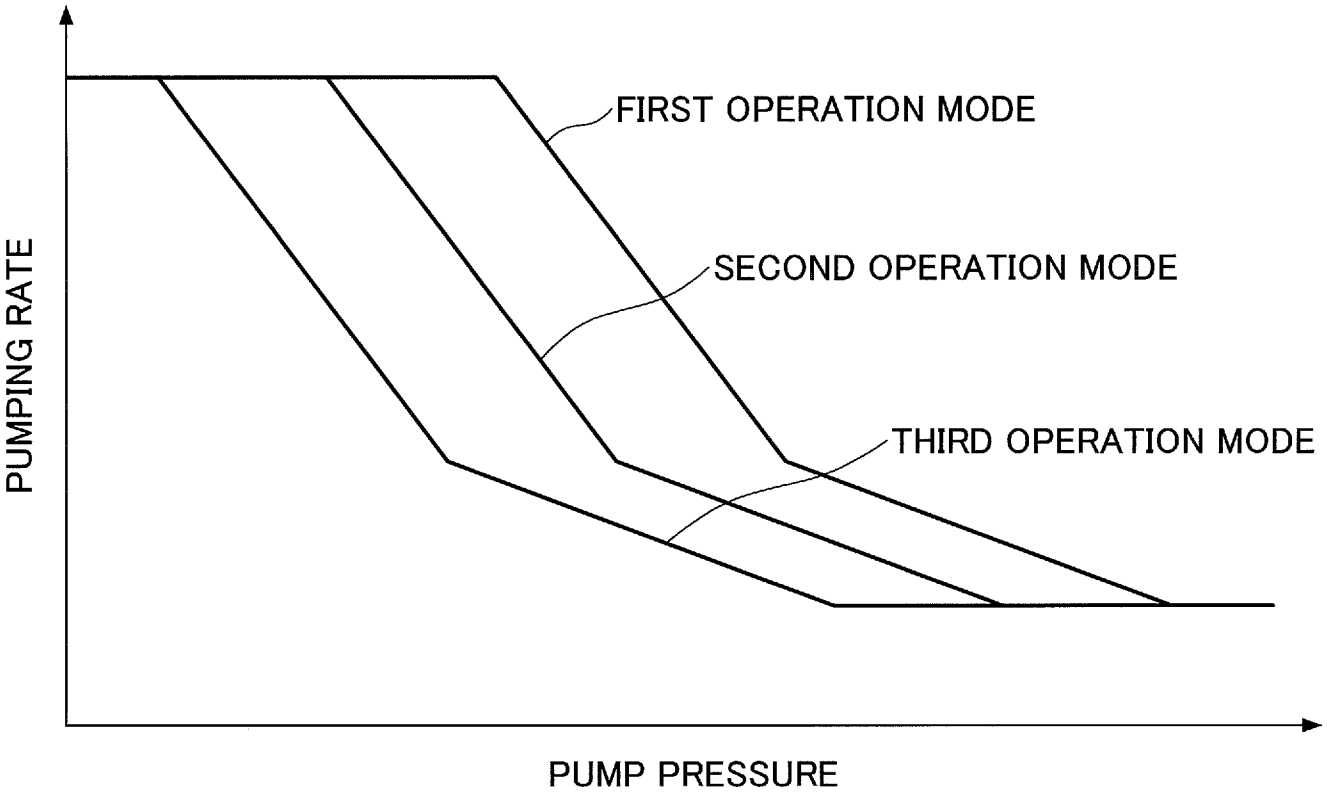
FIG. 8 is a graph illustrating relationships between pumping rates and pump pressures.

FIG. 8 is a graph illustrating relationships between pumping rates and pump pressures. In the present embodiment, the shovel is configured to operate in a first operation mode where emphasis is placed on speed and power, a second operation mode where emphasis is placed on fuel efficiency, or a third operation mode that is suitable for fine operations. The operation modes are set to adjust the pumping rates of the main pumps 12L and 12R with respect to the pump pressures such that the output horsepower in the first operation mode becomes greater than the output horsepower in the second operation mode and the output horsepower in the third operation mode becomes less than the output horsepower in the second operation mode.

The control unit 31 sets one of the operation modes that is predetermined for the type of work determined by the determining unit 32 and changes the horsepower of the main pumps 12L and 12R. For example, the control unit 31 sets the first operation mode when the shovel work is quarrying or earthwork, sets the second operation mode when the shovel work is material handling or felling, and sets the third operation mode when other types of work are to be performed. Thus, the control unit 31 sets operation modes predetermined for respective types of shovel work. For example, the control unit 31 sets the first operation mode when high output horsepower is necessary for the shovel work and sets the third operation mode when low output horsepower is sufficient for the shovel work.

For example, the control unit 31 sends control signals corresponding to the operation mode to the regulators 13L and 13R to adjust the inclination angles of the swash plates to increase or decrease the discharge rates and thereby control the output horsepower of the main pumps 12L and 12R. As illustrated in FIG. 3, the control unit 31 may also be configured to send a control signal corresponding to the operation mode to the engine to adjust the engine speed and thereby control the output horsepower of the main pumps 12L and 12R.

Thus, it is possible to optimally control a hydraulic actuator without outputting horsepower that is more than necessary for shovel work by controlling the output horsepower of the main pumps 12L and 12R according to an operation mode that is set according to the type of shovel work.

A shovel according to an embodiment of the present invention is described above. However, the present invention is not limited to the specifically disclosed embodiment, and variations and modifications may be made without departing from the scope of the present invention.

What is claimed is:

1. A shovel, comprising:

a lower traveling body that runs;

an upper rotating body that is rotatably mounted on the lower traveling body;

an attachment mounted on the upper rotating body;

a plurality of hydraulic actuators that are operated by hydraulic oil discharged by a hydraulic pump driven by an engine;

a determining unit that recognizes a type of a work site where the shovel is present and determines a type of work to be performed by the shovel based on the recognized type of the work site; and a control unit that controls the hydraulic actuators based on the type of the work determined by the determining unit.

2. The shovel as claimed in claim 1, further comprising:

an imaging device that captures an image of surroundings, wherein the determining unit recognizes the type of the work site based on the image captured by the imaging device.

3. The shovel as claimed in claim 1, further comprising:

a positioning device that obtains a current position; and a storage that stores geographical information, wherein the determining unit recognizes the type of the work site based on the current position obtained by the positioning device and the geographical information.

4. The shovel as claimed in claim 1, wherein the control unit changes distribution of flow rates of the hydraulic oil to the hydraulic actuators based on the type of the work determined by the determining unit.

5. The shovel as claimed in claim 1, wherein the control unit changes horsepower of the hydraulic pump based on the type of the work determined by the determining unit.

6. The shovel as claimed in claim 5, wherein the control unit changes the horsepower of the hydraulic pump by adjusting a regulator.

7. The shovel as claimed in claim 5, wherein the control unit changes the horsepower of the hydraulic pump by adjusting a speed of the engine.

* * * * *